US005927060A

United States Patent [19]

Watson

[11] Patent Number: 5,927,060

[45] Date of Patent: Jul. 27, 1999

[54] ELECTRICALLY CONDUCTIVE YARN

[75] Inventor: Douglas L. Watson, Dunwoody, Ga.

[73] Assignee: N.V. Bekaert S.A., Belgium

[21] Appl. No.: 08/954,164

[22] Filed: Oct. 20, 1997

[51] Int. Cl.[6] ..... D02G 3/02

[52] U.S. Cl. ..... 57/210; 57/212; 57/213; 57/222; 57/230; 337/163; 337/166

[58] Field of Search ..... 57/210, 212, 213, 57/222, 230, 901; 337/161, 163, 164, 166

[56] References Cited

U.S. PATENT DOCUMENTS

| | | | |
|---|---|---|---|
| 3,490,224 | 1/1970 | Bourgeas | 57/901 |
| 3,869,689 | 3/1975 | Kasamatu | 337/164 |
| 4,057,774 | 11/1977 | Arilawa et al. | 337/164 |
| 4,122,426 | 10/1978 | Maruo | 337/163 |
| 4,297,666 | 10/1981 | Asdollahi | 337/163 |
| 4,445,106 | 4/1984 | Shah | 337/163 |
| 4,517,544 | 5/1985 | Spaunhorst | 337/164 |
| 4,545,835 | 10/1985 | Gusack et al. | 57/901 |
| 4,560,971 | 12/1985 | Oh | 337/164 |
| 4,680,567 | 7/1987 | Edward | 337/164 |
| 4,736,180 | 4/1988 | Oh | 227/163 |
| 4,771,596 | 9/1988 | Klein | 57/901 |
| 4,776,160 | 10/1988 | Rees | 57/901 |
| 4,777,789 | 10/1988 | Kolmes et al. | 57/210 |
| 4,793,130 | 12/1988 | Togashi et al. | 57/901 |
| 4,838,017 | 6/1989 | Kolmes et al. | 57/210 |
| 4,972,169 | 11/1990 | Kalra | 337/163 |
| 5,142,262 | 8/1992 | Onken | 227/163 |
| 5,632,137 | 5/1997 | Kolmes et al. | 57/222 |
| 5,736,919 | 4/1998 | Reeder | 337/227 |

*Primary Examiner*—William Stryjewski
*Attorney, Agent, or Firm*—Nixon & Vanderhye P.C.

[57] ABSTRACT

A composite longitudinally balanced electrically conductive yarn has a textile fiber core yarn wrapped with a minimum of two, and a maximum four, filaments. One to four of the filaments are metal filaments with the remainder being synthetic filaments. Each metal filament has an equivalent diameter of between 20 and 80 microns, and a wrap frequency of between 200 and 600 turns per meter. At least one of the metal filaments is wrapped in one direction, and at least one of the remaining filaments is wrapped in the opposite direction. The composite yarns of this invention is capable of elongation to accommodate tensile stresses under use, without experiencing a change in conductivity.

11 Claims, 1 Drawing Sheet

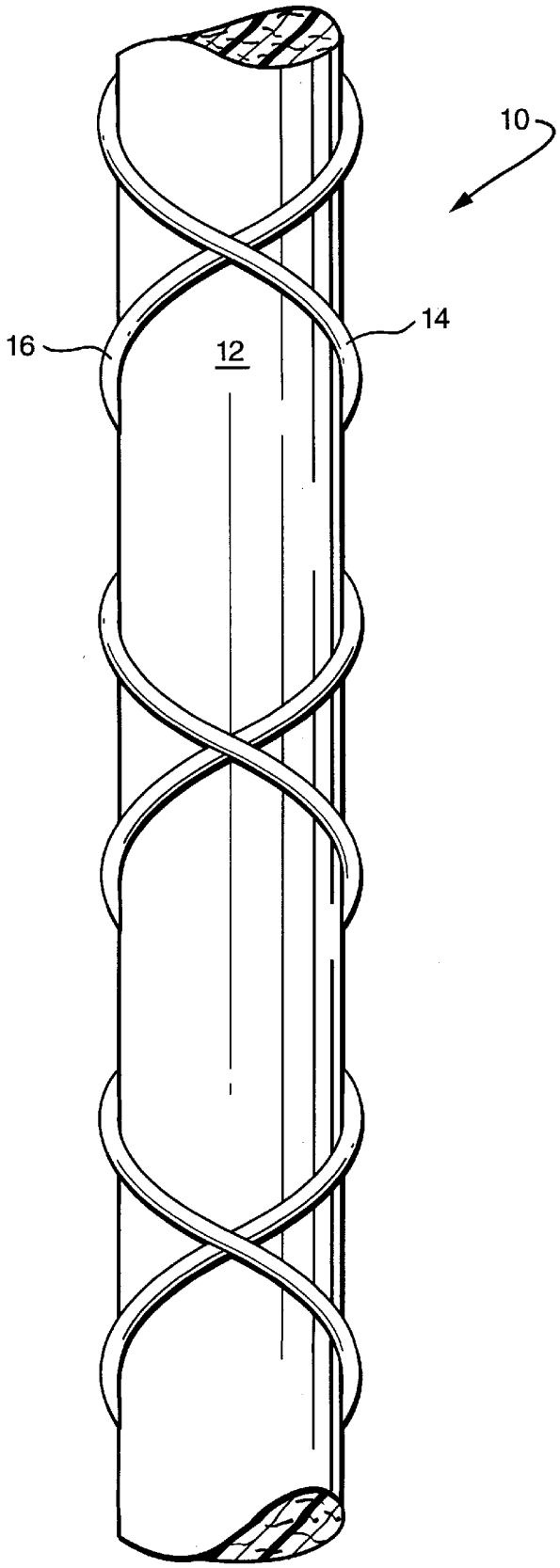
10
14
16
12

ELECTRICALLY CONDUCTIVE YARN

FIELD OF THE INVENTION

The present invention relates to a composite yarn with a predetermined electrical conductivity, flexibility and elongation behavior and which comprises metal fibers.

BACKGROUND OF THE INVENTION

The blending of broken metal fibers, e.g. stainless steel fibers with natural or synthetic textile fibers to produce conductive yarns is well known. The conductive fibers are dispersed throughout the cross section of the yarn during spinning. However, since the modulus of elasticity of metal and textile fiber differ significantly, it is difficult to reach and retain a permanently homogeneous metal distribution in the yarn. In particular, when repeatedly loading the yarns under tensile and/or bending or torsion stresses, the initial fiber distribution may alter in the yarn cross section as well as along the yarn length. As a consequence its conductivity may change in an uncontrollable manner.

SUMMARY OF THE INVENTION

It is now an object of the invention to design a composite yarn comprising metal fibers and having a predetermined electrical conductivity which remains constant during use, i.e. under different stress or strain conditions. In particular, it is an object to design such a yarn which properly can elongate to accommodate tensile stresses under use, without changing its conductivity.

It is another object of the invention to design such a yarn of controlled rigidity. For certain uses a high flexibility is required, i.e. having a flex life of at least 30,000 bending cycles and preferably at least 40,000 cycles.

According to an additional object of the invention, the composite yarn must have a torque which is fully balanced along its length so that it can be easily incorporated e.g. into woven, knotted, braided or knitted fabrics. A balanced yarn thus means here a yarn with almost no or without any residual torsion. The invention relates also to fabrics, in particular textile fabrics, wherein at least one such composite yarn is incorporated.

Yet, a further object of the invention deals with the provision of a rapid ignition and burn through capacity for the yarn. This means that the metal filaments therein can ignite already at relatively low temperatures.

In summary, in a preferred embodiment, the composite yarn according to the invention should thus enable a balancing of the needs for a proper conductivity, flexibility, elongation, low residual torsion and low ignition energy.

These objects are met by providing a textile fiber core yarn or core bundle which is wrapped with minimum two and maximum four filaments of which one to four are metal filaments and the rest are synthetic filaments and wherein each metal filament has an equivalent diameter of between 20 and 80 microns and wherein the wrap frequency of each filament is between 200 and 600 turns per meter, at least one of said metal filaments being wrapped in one direction, and at least one of the remaining filaments being wrapped in the opposite direction. The equivalent diameter of the metal filaments is preferably between 30 and 55 micron and most preferably between 30 and 40 micron. The metal is preferably stainless steel.

The fiber core yarn is preferably a multifilament synthetic yarn and has a size of between 250 and 2400 denier and preferably between 250 and 800 denier. The helical wrapping is not very tight so that the yarn can elongate quite easily up to e.g. five %. This means that the core yarn can elongate 5% and take up the initial tensile stresses under elongation before the metal filaments are loaded under tensile stress.

Actually, the choice and range of parameters just described enable to fulfill the need to properly balance conductivity, flexibility, elongation capacity, low torque and low ignition energy. This need is thus fulfilled by properly adjusting the numbers and diameters of the metal filaments, their spacing, the wrapping tension and the composition of the metal.

If desired, the yarn that is wrapped with the metal filaments can further be covered by another layer (e.g. by extrusion) that can act as a protective or isolating cover or sheath. This cover can comprise another textile fiber layer. One or more series of parallel composite conductive yarns, which series can cross each other, can be sandwiched between two plastic foils to form a laminated sheet capable of shielding electromagnetic waves, e.g. microwaves.

In a preferred embodiment, the composite yarn according to the invention comprises one metal filament wrapped in one direction (S-, respectively Z-direction) and one filament wrapped in the opposite direction (Z-, respectively S-direction). The filament wrapped in the opposite direction is preferably also a metal filament and has the same or a similar wrap frequency as the metal filament in the one direction.

In another preferred embodiment the composite yarn comprises two metal filaments wrapped in the one direction and two metal filaments wrapped in the opposite direction, the wrap frequency of all four filaments being either the same or similar.

BRIEF DESCRIPTION OF THE ACCOMPANYING DRAWING

The accompanying Drawing FIGURE shows one preferred composite yarn according to the present invention as being comprised of a core yarn wrapped in opposite direction by respective metal filaments.

DETAILED DESCRIPTION OF THE PREFERRED EXEMPLARY EMBODIMENTS

A first conductive yarn was produced for use as a long safety circuit or fuse running alongside a conventional electrical wire circuit to interrupt incidental short circuits therein. At the occurrence of a sudden undesired short in the circuit, the metal filaments in the yarn of the invention that runs alongside the circuit act as a fuse. They burn through (melt down) at the place of the short in the main circuit and thereby give a signal to the power supply unit to shut off the current flow in the wire circuit. This feature can be used e.g. for protecting electrical heating circuits in blankets, in foot warmers, quilts, mattresses, mattress pads and comforters, i.e. for preventing the generation of fires therein or electrical shocks or other injuries to the user.

For this purpose, the yarn of the invention comprised a polyester core yarn of 600 denier. This core yarn was wrapped by two stainless steel filaments in Z-direction and two such filaments in S-direction to balance the overall torque alongside the yarn, i.e. to produce a yarn with almost zero residual torsion. The steel filaments had an equivalent diameter of 35 micron. They can be produced either by direct drawing, by a bundle drawing technique or by a shaving technique as disclosed in U.S. Pat. No. 4,930,199.

The steel filaments were quite loosely wrapped with 350 turns per meter. In this way they only start to contribute to bearing tensile stresses in the overall yarn after the core yarn has already elongated by about 5%. The yarn had a resistivity of about 180 Ohm/m and, when used as a safety circuit in a heating blanket, the burning-through time was less than 20 sec. The flex life of the yarn was 40,000 cycles as determined by the test UL 964, 10th edition.

The accompanying drawing FIGURE shows a composite yarn 10 according to the present invention. The composite yarn includes a core yarn 12 wrapped in opposite directions by respective metal filaments 14, 16.

Since the burn-through time for the composite yarn is a quite critical parameter for the use in safety circuits, a simple ignition test was applied to it. The composite yarn described above was put above a candle flame and the four stainless steel filaments burned through almost instantly although a candle flame can be considered to simulate a relatively low temperature when it generates an immediate ignition. Similarly, a single stainless steel filament of 35 micron diameter burns through instantaneously. It ignites and burns for a few centimeters like a fuse on a firecracker before extinguishing. A stainless steel filament with a diameter of 43 microns doesn't burn through as rapidly but still within less than one second. On the contrary, a 140 micron filament did not burn through within a time span of 20 seconds.

The stainless steel filaments used in this invention offer also the advantage that they properly withstand laundering operations of the fabrics in which they are incorporated.

A similar type of yarn was used for carrying the electrical current in electrically heatable outerwear fabrics. The synthetic core was a 150–300 denier yarn and was wrapped with 4 stainless steel filaments of each 35 microns as described above. The yarn was knitted into the outerwear fabric.

Another type of yarn (600 denier core and 4 wraps of stainless steel of each 35 microns) was used as a suitable lead wire for medical electrode applications (electro-massage). The yarn then carries the current flow between the electrode or sensor and the current source or—in a bio-feed back device—between the sensor and the measuring or test device.

It is also possible to replace one or more of the metal wrap filaments by a synthetic filament, in view of balancing the torsion in the overall conductive yarn structure. As an example, synthetic core yarns (70 denier polyester) were wrapped with one stainless steel filament of e.g. 35 microns diameter in S-direction and one 40 denier polyester filament in Z-direction. They were interwoven in apparel fabrics usable to render them antistatic and in tent fabrics to shield them against electromagnetic waves.

I claim:

1. An electrical safety circuit or fuse which includes a composite longitudinally balanced electrically conductive yarn, said yarn comprising a textile fiber core yarn wrapped with minimum two and maximum four filaments of which one to four are metal filaments and the rest synthetic filaments and wherein each metal filament has an equivalent diameter of between 20 and 80 microns and wherein the wrap frequency of each filament is between 200 and 600 turns per meter, at least one of said metal filaments being wrapped in one direction, and at least one of the remaining filaments being wrapped in the opposite direction.

2. An electrical safety circuit or fuse according to claim 1, wherein the composite yarn has a flex life of at least 30,000 cycles.

3. An electrical safety circuit or fuse according to claim 1, wherein said core yarn of said composite yarn has a size of 250 to 2400 denier.

4. An electrical safety circuit or fuse according to claim 1, wherein said equivalent diameter of each said metal filament is between 30 and 55.

5. An electrical safety circuit or fuse according to claim 4, wherein the equivalent diameter of each said metal filament is between 30 to 40 micron.

6. An electrical safety circuit or fuse according to claim 1, wherein the metal is stainless steel.

7. An electrical safety circuit or fuse according to claim 1, wherein said composite yarn comprises a covering of a non-conductive material.

8. An electrical safety circuit or fuse according to claim 1, wherein said composite yarn comprises one metal filament wrapped in one direction and one metal filament wrapped in the opposite direction.

9. An electrical safety circuit or fuse according to claim 8, wherein the filament wrapped in the opposite direction is also a metal filament and has the same wrap frequency as the metal filament in the one direction.

10. An electrical safety circuit or fuse according to claim 1, wherein said composite yarn comprises two metal filaments wrapped in the one direction and two metal filaments wrapped in the opposite direction, the wrap frequency of all four filaments being the same.

11. An electrical safety circuit or fuse according to claim 1, wherein said yarn has a burn-through time of less than 20 seconds.

* * * * *